United States Patent [19]

Avot

[11] Patent Number: 5,007,550

[45] Date of Patent: Apr. 16, 1991

[54] CONTAINER

[75] Inventor: Jean-Pierre Avot, les Loges en Josas, France

[73] Assignee: Sonabat-Chantal - a French Society, de Bretagne, France

[21] Appl. No.: 393,939

[22] Filed: Aug. 15, 1989

[30] Foreign Application Priority Data

Aug. 16, 1988 [FR] France ..... 88 10920

[51] Int. Cl.[5] ..... B65D 6/16

[52] U.S. Cl. ..... 220/8; 220/4.03; 220/4.21

[58] Field of Search ..... 220/8, 4 A, 4.03, 4.21, 220/4 B, 4 C, 85 B, 93, 22.3, 22.1, 345, 255

[56] References Cited

U.S. PATENT DOCUMENTS

| | | | |
|---|---|---|---|
| 872,837 | 12/1907 | Mio | 220/8 |
| 1,469,347 | 10/1923 | Westin | 220/22.1 |
| 1,659,721 | 2/1928 | Chauncey | 220/8 |
| 1,858,179 | 8/1930 | Bay | 220/8 |
| 3,232,439 | 2/1966 | Dahl | 220/8 |
| 3,648,831 | 3/1972 | Arone | 220/345 |
| 3,887,102 | 6/1975 | Earley | 220/8 |
| 3,901,406 | 8/1975 | Kivett | 220/8 |
| 3,942,019 | 3/1976 | Claridge | 220/8 |
| 3,951,486 | 4/1976 | Tracy | 220/18 |
| 4,030,602 | 6/1977 | Muller | 220/8 |
| 4,161,268 | 7/1979 | Heil | 220/8 |
| 4,390,217 | 6/1983 | Wagner | 220/4 B |
| 4,436,215 | 3/1984 | Kleinert | 220/22 |
| 4,564,118 | 1/1986 | Heyer | 220/8 |
| 4,749,097 | 6/1988 | Rosman | 220/4 B |
| 4,766,519 | 8/1988 | Heiland | 220/4 B |

FOREIGN PATENT DOCUMENTS

| | | | |
|---|---|---|---|
| 2088334 | 6/1982 | United Kingdom | 220/8 |

*Primary Examiner*—Stephen Marcus
*Assistant Examiner*—S. Castellano
*Attorney, Agent, or Firm*—Sherman Levy

[57] ABSTRACT

A container of adjustable width including a base, a back, a front edge and two side walls, the container being characterized in that it is formed by two elements (1, 2) each including a side wall (3, 13) bounded by the back (4, 14) and a base part, the back parts (4, 14) and the base parts (5, 15) of the two elements (1, 2) overlapping each other to enable the width (L) of the container to be adjusted by the movement of the two elements (1, 2) towards or away from each other.

3 Claims, 5 Drawing Sheets

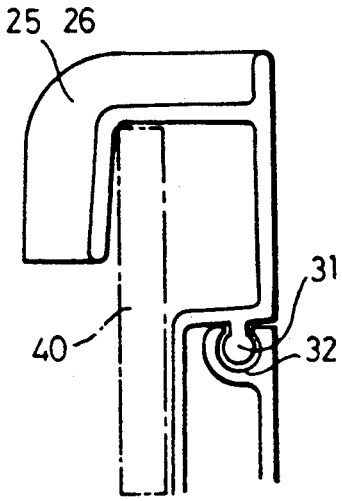
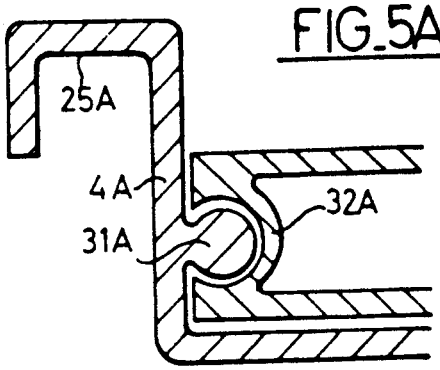
FIG_5A
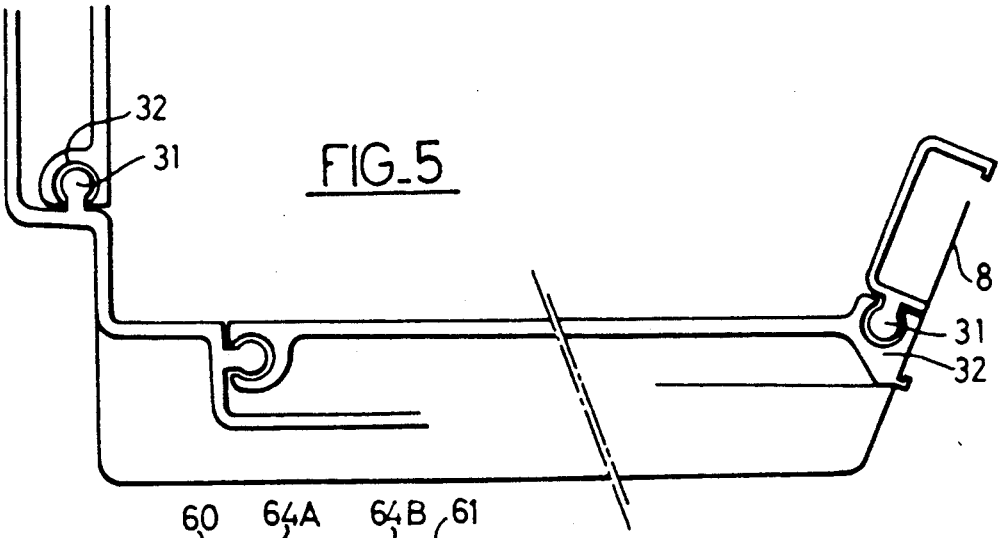
FIG_5
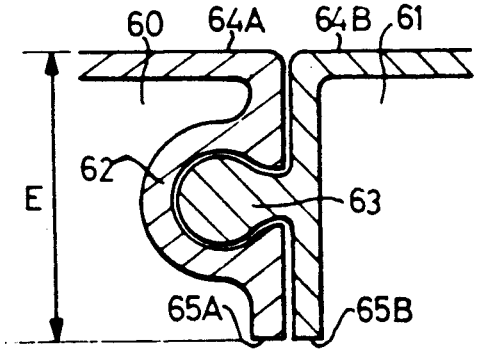
FIG_6A
FIG_6
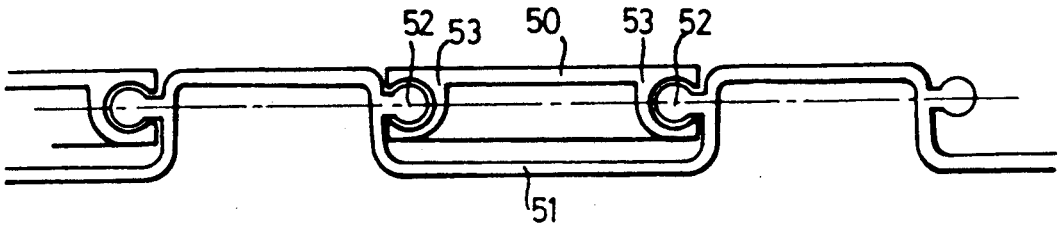

CONTAINER

The present invention relates to a container for various uses, particularly for the transportation, handling and display of products on shelves or display units in shops, or for the storage and stocking of items.

Many products packed in paper, plastics, glass or metal packaging, are assembled in lots in corrugated cardboard boxes. These boxes are themselves placed on pallets and thus enable the products to be stored and transported between the place of manufacture and the place of sale.

At the place of sale, the products are then removed from the pallets and from their corrugated cardboard packaging and placed on the shelves of the display units.

This method of packaging, transporting and displaying the products requires a large number of manual operations resulting in high logistical costs.

Moreover, the packaging cost is high since the corrugated cardboard boxes cannot be re-used, on the one hand because of their fragility and on the other hand because their size is suitable for one product and one only. Furthermore, the American standard corrugated cardboard box does not adapt itself well to the display of the products in the shop.

Finally, the disposal of the non-returnable packaging in the shop is not without problems.

The present invention aims to resolve these problems and proposes the creation of a container which, in particular, enables very different products to be assembled in lots for storage, handling, transportation and, in particular, for display in the shop, in the same container.

For this purpose, the invention relates to a container formed by a base, a back, a front and two side walls, the container being characterised in that it is formed by two elements each including a side wall bounded by base, back and front parts, the back, front and base parts of the two elements overlapping each other so as to enable the width of the container to be adjusted by the movement of the two elements towards or away from each other.

The two elements can be adjusted telescopically in order to adapt the container to the sizes of the products to be contained. When the container is filled it is covered by a heat-shrinkable film which ensures that the unit is tightened and secured around the products. The container can then be placed on a pallet.

When it is received, the container is placed directly on the shelves or display units. According to circumstances, the packaging film is removed before or after positioning in the shop.

Since the container has neither a top nor a large front wall, the products which it contains are visible and suitably accessible.

When the container is empty, it is easy to replace it by a full container. The empty container can be reduced in size by a telescopic movement of the two elements into each other, so that its size is decreased.

The containers can also be fitted inside each other by being reduced to progressively smaller sizes by means of the telescopic movement, so that the assembly occupies a very small space.

Many units can thus be fitted inside each other and sent back to the supplier at very little expense.

According to another characteristic, the base, back and front parts are formed with fingers which slide relative to each other.

Particularly advantageously, the base part and the back part of one of the elements are formed as plates with cross-sections like a Greek key-pattern with grooves and ribs and the base part and the back part of the other element are formed with fingers which slide in the grooves formed in the part of the first element which has a cross-section like a Greek key-pattern.

By virtue of the form overlap of the grooved plate and the fingers, there is continuous adjustability widthwise enabling the container to be adapted to any product (to a multiple of the dimensions of one package) without wastage of space, the assembly being kept constricted by the heat-shrinkable film.

By virtue of the finger shapes and, more precisely, of the shapes of the plates with Greek - key-pattern cross-sections forming ribs and grooves, and of the fingers of corresponding shape which are housed in the grooves in the wall forming the base, as well as that forming the back, and since these two walls are perpendicular to each other, the fingers are locked against movement in a direction perpendicular to the grooves simply by being positioned therein: the fingers of the base cannot be moved backwards and forwards, but only transversely. This locking in a front-to-back direction ensures that the fingers of the back are locked in their grooves in a perpendicular direction, and the fact that the fingers are kept in the grooves of the back in the same manner ensures the locking of the fingers of the base: the fingers of the back and of the base cannot therefore come out of their grooves.

Similarly, the shapes of the fingers cooperating with the shapes of the plates with the Greek-key-pattern cross-sections defining ribs and grooves for housing the fingers provide an excellent flat base. This results in good stability for the products placed straddling the fingers and the ribs.

According to another advantageous characteristic, the upper parts of the back walls have hook-shaped cross-sections enabling the container to be hooked onto a support bar, the lower part of the container also bearing against another bar or support to prevent swinging. This enables the shelves of the display units in the shop to be omitted.

According to another characteristic, the side walls have feet which are thicker than the base, so as to enable the insertion of the fork of a loading member under the base.

In order to improve the firmness of the filled container and to prevent it sagging in the middle, the ends either of the fingers, or of the part with a notched cross-section have studs whose bases are at the same level as the two side feet.

According to another characteristic the edges of the ribs and grooves in which the fingers slide telescopically are provided with toothed engagement means which, whilst allowing the telescopic movement, define certain width positions and retain the two elements in one of these positions.

The present invention will be described in more detail with the aid of the appended drawings, in which:

FIG. 5 is a partial section of the back and of the base of a variant;

FIG. 5A is a section similar to that of FIG. 5 of a variant of the back, but showing only the back and part of the base;

FIG. 6 shows part of the base structure of the container of FIG. 5;

FIG. 6A shows another embodiment of the elements and their telescopic connection means.

Figure 1:
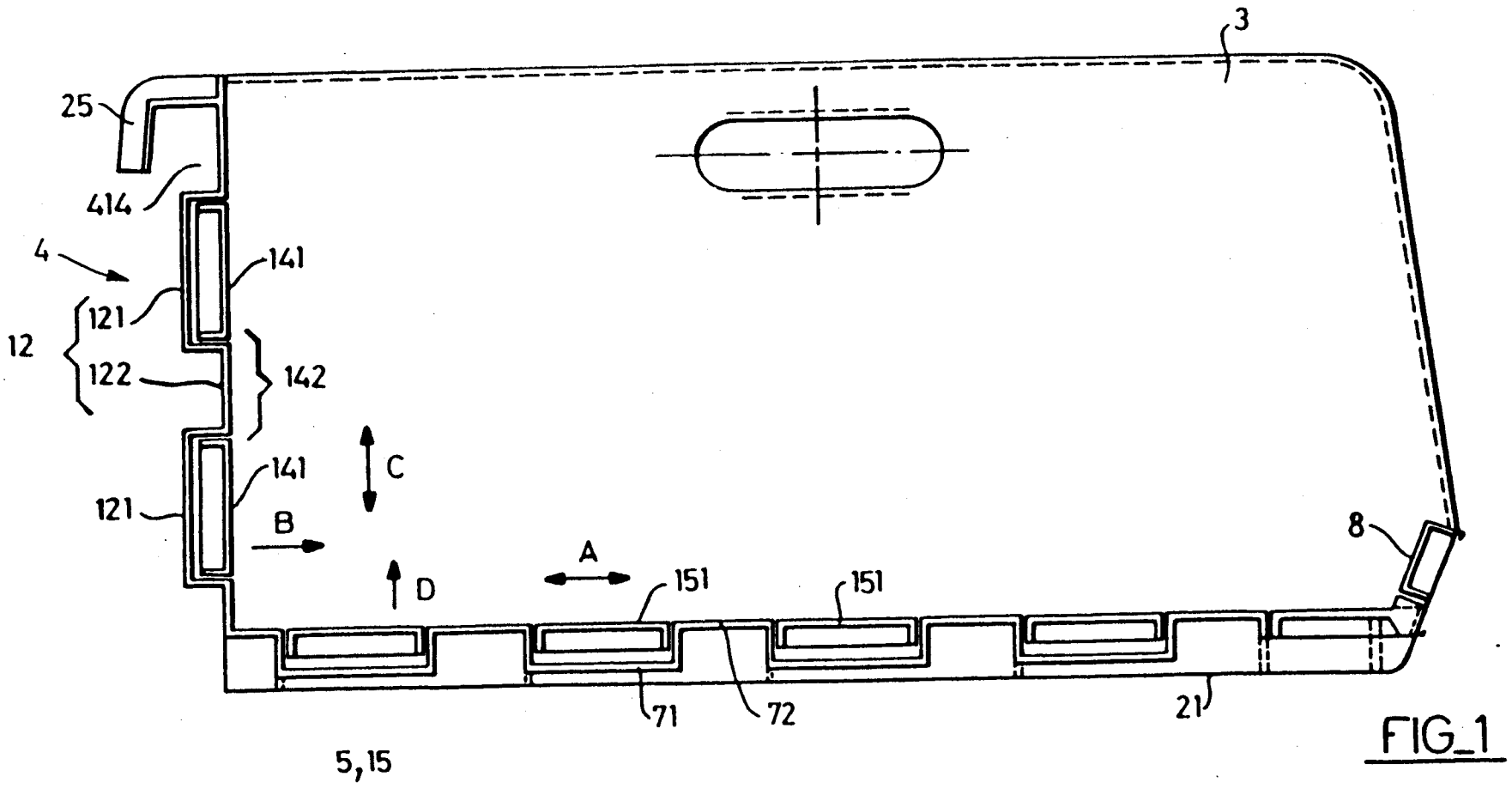
FIG. 1 is a section taken on the line I—I of FIG. 3, showing one of the side walls of the container, as well as the shape of the back and of the base.

According to FIGS. 1–4, the container is constituted by two overlapping elements 1, 2 which are adjustable telescopically in the direction of their width to enable the width L of the container to be adjusted.

The element 1 is constituted by a side wall 3, a back part 4 and a base part 5. The base part 5 is formed by an end part 6 bordering the side wall 3 and a part 7 with a cross-section like a Greek key-pattern (a rectangular outline forming grooves 71 and ribs 72). The end of this base part is level with the line 73. The end of the back part 4 is also on this line. The same is true of the end of the part 8 which forms the front wall.

Similarly, the element 2 is constituted by a side wall 13, a back part 14 and a base part 15 including fingers 151, separated by spaces 152. The cross-sections of the fingers 151 correspond to those of the grooves 71 and the fingers 151 slide in the grooves 71 whilst the spaces 152 are occupied by the ribs 72.

According to FIG. 1, the base structure formed by the two parts 5, 15, and the back structure formed by the parts 4, 14, are similar. The part 4 of the back which belongs to the element 1 has a part 12 with a cross-section like a Greek key-pattern, composed of grooves 121 and ribs 122. The grooves 121 house the fingers 141 of the part 14 of the back which belongs to the element 2. The space 142 between the fingers 141 houses the rib 122.

The arrangement of the grooves 71, 121 and of the fingers 151, 141 in the two perpendicular walls enables the telescopic connection to be locked in the manner described below:

The lateral guiding of the fingers 151 in the grooves 71 prevents the fingers or grooves from moving transversely in the direction of the double arrow A but enables them to move only in the perpendicular direction (arrow D). This locking in the direction of the double arrow A prevents the fingers 141 from coming out of their grooves 121 in the back 4, 14, in the direction of the arrow B. Likewise, the lateral locking of the fingers 141 in the direction of the double arrow C by the edges of the grooves 121 prevents the fingers 151 from being lifted in the direction of the arrow D.

Thus, in brief, there is a mutual locking of the assemblies of the fingers 151 in the grooves 71 and of the fingers 141 in the grooves 121.

Figure 2:
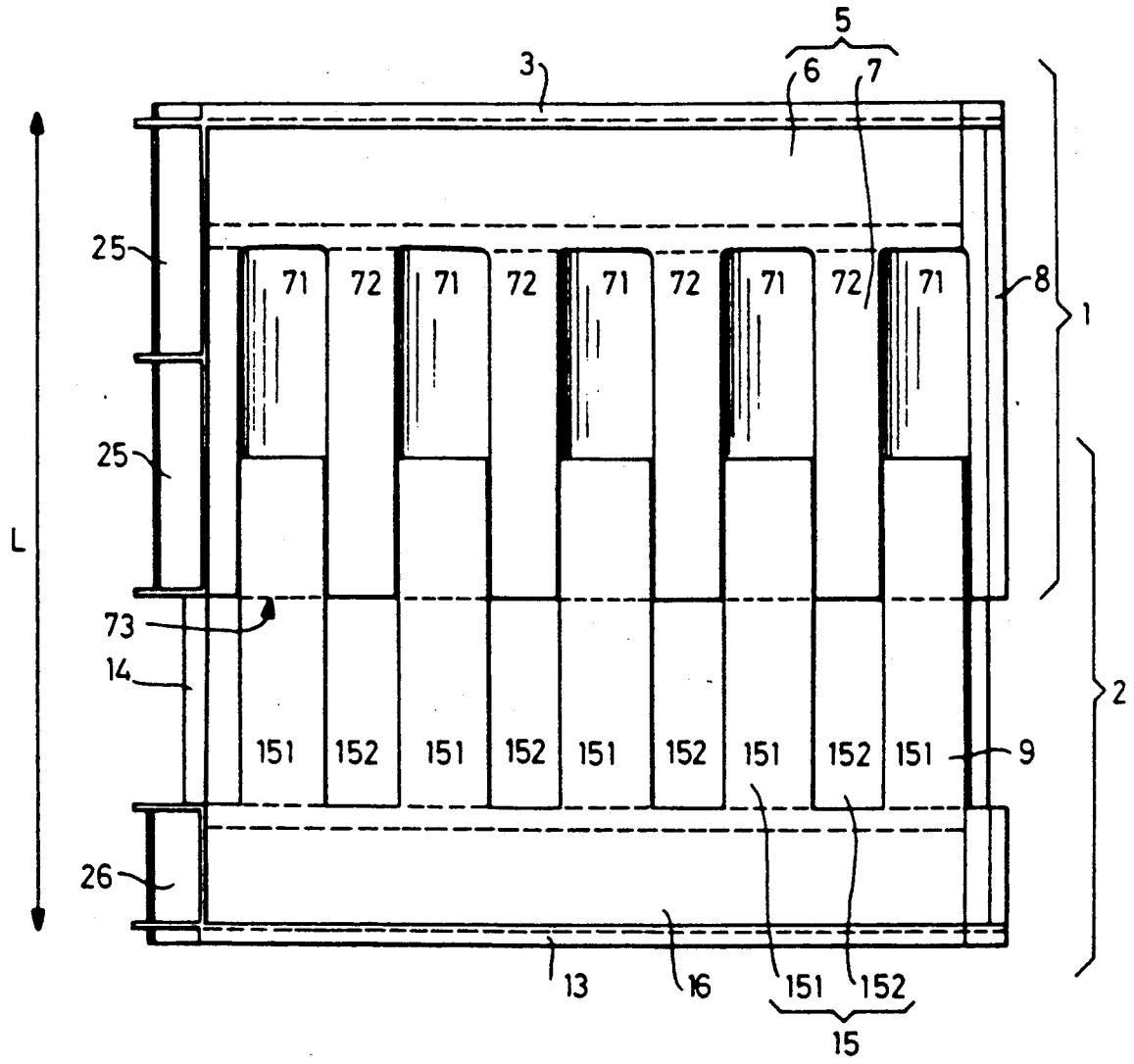
FIG. 2 is a view of the container from above.

Finally, according to FIG. 2, the fingers 151 and their spaces 152 do not extend as far as the wall 13 but leave a continuous end part 16 which has no Greek key-pattern profile.

The fingers 141 of the back part 14 of the element 2 likewise leave an end part 46.

Similarly, the Greek- key-pattern section does not extend as far as the wall 3; it leaves an end part 6 and there is an end part 36 in the back part 4.

Figure 3:
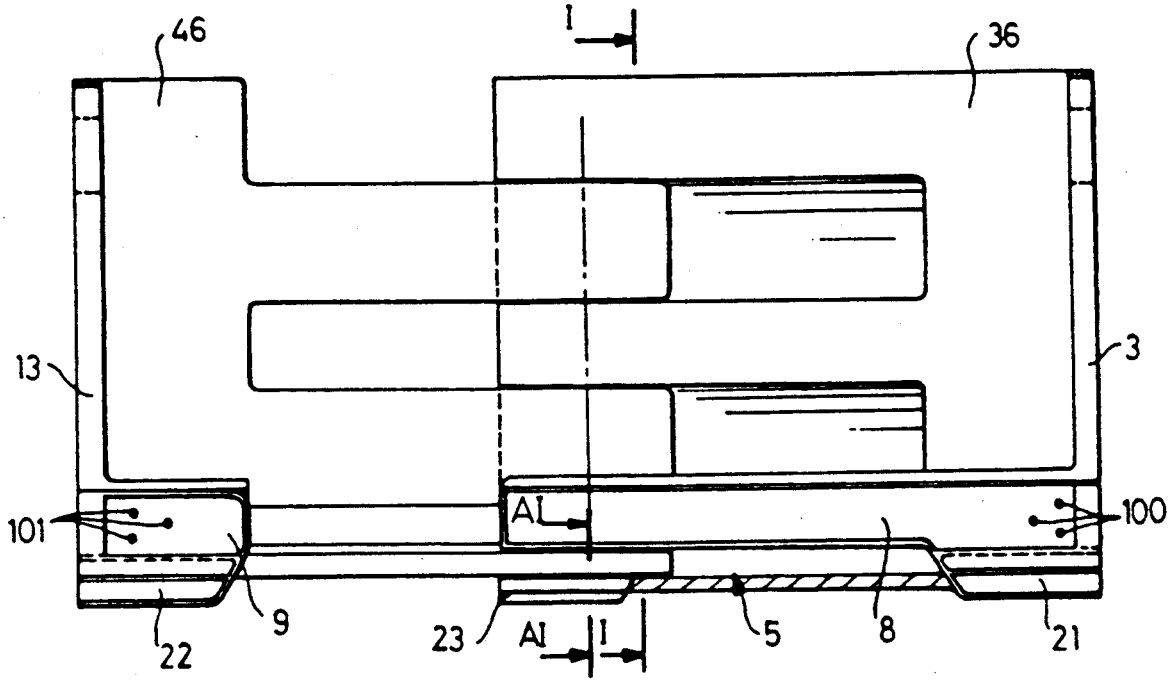
FIG. 3 is a front view of the container.
Figure 4:
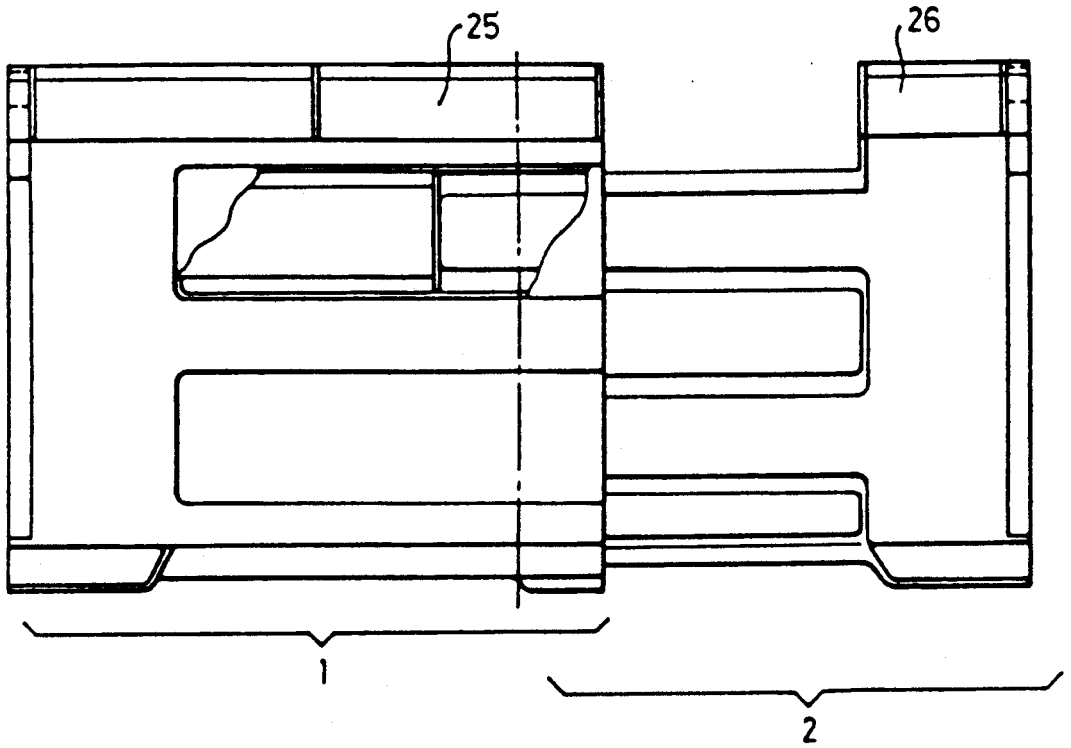
FIG. 4 is a back view of the container.

According to FIGS. 1, 3 and 4, blocks or feet 21, 22 are formed in the side walls 3, 13 and serve as supports. The free end of the part 5 of the base of the element 1 is similarly provided with a stud 23 which serves as an intermediate support.

Figure 1A:
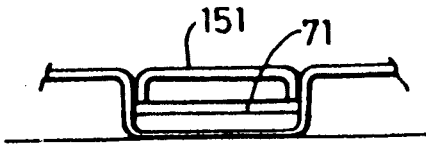
FIG. 1A is a section taken on the line AI—AI of FIG. 3, and is restricted to the telescopic engagement of a finger in a groove level with the part in which a stud is formed.

FIG. 1A shows the groove 71 and the corresponding finger 151.

In FIGS. 2 and 3 it can be seen that the front wall part 8 cooperates with the front wall part 9 of the element 2.

Finally, according to FIGS. 1–4, the tops of the back parts 4, 14 of the elements 1 and 2 respectively have hooks 25, 26 which enable the container to be hooked onto a bar, the width of the hook 26 corresponding only to that of the end part 16.

This angled part is provided with reinforcing ribs.

According to FIG. 3, the front wall parts 8, 9 each have fixing means 100, 101, for example in the form of pins, for holding a plastic tape, which is preferably very strong, and has perforations which correspond to the pins 100, 101. The tape, which is not shown, may carry printed advertising material, indications of the type of products, their quality, price etc.

The engagement of the tape on the spikes 100, 101 or on any other releasable fixing means, also enables the two elements 1, 2 to be held together after the positioning of the products. This tape completes, and in some cases, replaces the heat-shrinkable film.

FIGS. 5 and 6 show a variant of the invention. This variant differs from the embodiment described above only in its male and female connecting members 31, 32. These are formed in the grooves and on the fingers and, whilst enabling the relative telescopic movement of the two elements, help to keep the fingers in the grooves, to prevent the internal stresses induced in the plastics material during the production of the elements 1 and 2 from making one or other of the fingers come out of its groove, or vice versa. The same connection is also provided on the front wall part 8 of the container by a male part 31 and a female part 32.

Finally, FIG. 5 shows the bar 40 on which can be fixed the hooks 25, 26 which have already been described above and which are also provided on this second embodiment.

The variant of the container shown in FIG. 5A corresponds to an embodiment with a low back 4*a* integral with the edge 25A which forms the hook. In this variant, the connection members 31A, 32A are similar to those of FIG. 5.

FIG. 6 shows in more detail the shape of the base of the container shown in FIG. 5. This figure shows the excellent flatness of the upper surface of the base by virtue of the shapes of the fingers 50 which slide in the grooves 51. Connection members 52, 53 ensure the connection and the telescopic movement.

FIG. 6A is a variant of the assembly and telescopic connection by means of male and female parts.

In this case, one of the elements has only ribs 60 and the other has fingers 61 which are placed in the spaces between the ribs 60. The latter (60) may be connected by studs such as the stud 23 of the embodiment shown in FIGS. 1 to 3.

The ribs 60 and the fingers 61 are connected by connecting members 62, 63 similar to those already described.

It should be noted that this embodiment, which omits the grooves, enables the ribs 60 and the fingers 61 to be formed with the same thickness E, that is, so that not only their upper surfaces 64A, 64B, but also their lower surfaces 65A, 65B are at the same respective levels.

Figure 7:
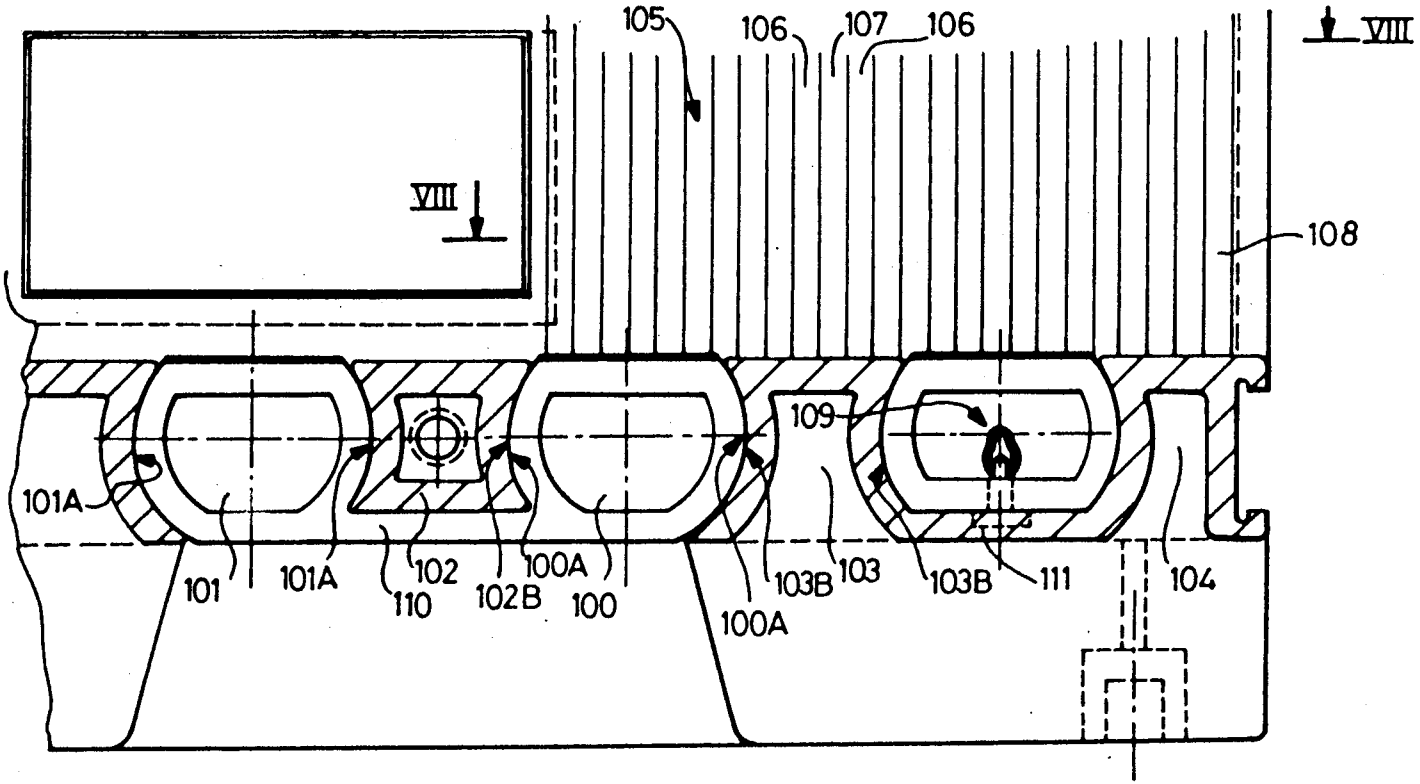
FIG. 7 is a partial sectional view of another variant and corresponds to the view of FIG. 5.
Figure 8:
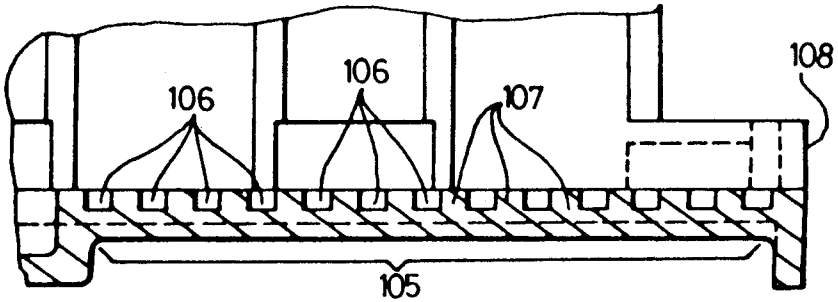
FIG. 8 is a section taken on the line VIII—VIII of FIG. 7.

FIGS. 7 and 8 are details of another embodiment of the invention.

This is characterised by fingers 100, 101 which have convex rounded sides 100A, 101A on one of the base parts of the container and fingers with concave rounded sides 102B, 103B on the other part.

It should be noted that the upper faces of the fingers 100, 101, 102, 103 are flat and at the same level as in the other embodiments, so as to provide a flat surface for the products in the container.

The back of the container, which is not shown, is formed in the same manner as the base.

The front part has been omitted and replaced by a region 105 with grooves 106, which are preferably vertical and separated by ribs 107.

The facing grooves 106 form guides for a removable front partition which can be placed in a position which is defined in dependence on the products situated in the container.

The front edge 108 of the base forms a housing with guide grooves for a display plate, for example a label describing the products and their price (not shown).

FIG. 7 also shows a rivet 109 which serves as guiding and abutment means. A rivet is engaged in a hole at the end of each of one or more fingers of the base and, if necessary, of the side walls.

Finally, according to the variant shown in FIG. 7, the fingers 100, 101 of one part (shaded) are connected by a strip 110 and the fingers 103, 104 of the other part are connected by a strip 111.

The various variants of the containers described above are used for the grouping together and transportation of products intended to be displayed for sale in the containers. In order to keep the container closed and the products grouped, the container filled with products is secured by a heat-shrinkable film or by a stretchable film.

The invention can also be used for other purposes, and in particular as a storage container, for example a bin holding items of various sizes in a storage area, a warehouse, etc. The container can also serve as a storage drawer. The side walls are then provided with shoulders whose lower sides fit in the running tracks on which the drawer slides.

I claim:

1. A container of adjustable width including a base, a back, a front edge and two side walls, Said container formed by two elements (1, 2) each including one of said side walls (3, 13) bounded by part of the back (4, 14) and part of the base (5, 15), the back parts (4, 14) and the base parts (5, 15) of the two elements (1, 2) overlapping each other telescopically to enable the width (L) of the container to be adjusted by the movement of the two elements (1, 2) towards or away from each other, the base parts (5, 15) and the back parts (4, 14) of each element (1, 2) formed with fingers leaving intervals between them, the fingers and intervals having similar configuration in cross-section so that the shape of the fingers correspond to the shape of the intervals, the fingers of one of said elements (1, 2) sliding into the intervals between the fingers of the other of said elements (2, 1), wherein the fingers of the one element have rounded convex sides and flat upper surfaces, while the fingers of the other element have rounded concave sides and flat upper and lower surfaces, the contact between the concave and convex surfaces provides an interlocking engagement of the elements that restricts movement perpendicular to the telescopic movement.

2. A container according to claim 1 whose back is formed with hooks (25, 26).

3. A container according to claim 1 in which a part (1) of the two elements (1, 2) is provided with a stud (23).

* * * * *